US007674013B2

(12) United States Patent
Leslie et al.

(10) Patent No.: US 7,674,013 B2
(45) Date of Patent: Mar. 9, 2010

(54) UTILITY LIGHT

(75) Inventors: Stuart Leslie, Larchmont, NY (US); David Mallard, Somerville, MA (US); Elliott P. Montgomery, Brooklyn, NY (US); Taek Kim, Washington Township, NJ (US); Roland Zeder, New Yirk, NY (US)

(73) Assignee: Honeywell International Inc., Morristown, NJ (US)

( * ) Notice: Subject to any disclaimer, the term of this patent is extended or adjusted under 35 U.S.C. 154(b) by 182 days.

(21) Appl. No.: 11/837,501

(22) Filed: Aug. 11, 2007

(65) Prior Publication Data

US 2008/0037251 A1 Feb. 14, 2008

Related U.S. Application Data

(60) Provisional application No. 60/837,063, filed on Aug. 11, 2006.

(51) Int. Cl.
*F21V 23/04* (2006.01)
*F21V 15/01* (2006.01)

(52) U.S. Cl. ..... 362/249.05; 362/196; 362/200; 362/208; 362/249.02; 362/184

(58) Field of Classification Search ..... 362/184, 362/196, 200, 208, 249.02, 249.05
See application file for complete search history.

(56) References Cited

U.S. PATENT DOCUMENTS

| | | | | |
|---|---|---|---|---|
| 4,290,098 | A * | 9/1981 | Pierson | 362/485 |
| 5,627,513 | A | 5/1997 | Weed et al. | |
| 6,834,981 | B2 * | 12/2004 | Nagai et al. | 362/240 |
| 7,163,313 | B2 * | 1/2007 | Rosenberg | 362/184 |
| 7,222,985 | B2 * | 5/2007 | Henoch | 362/196 |
| 7,597,452 | B2 * | 10/2009 | Jeng et al. | 362/234 |

* cited by examiner

*Primary Examiner*—Stephen F Husar
*Assistant Examiner*—James W Cranson
(74) *Attorney, Agent, or Firm*—Cantor Colburn LLP

(57) ABSTRACT

A light assembly, comprising: a translucent housing; an inner wall disposed in the translucent housing, the inner wall and the translucent housing defining an inner cavity; a plurality of light emitting diodes electrically coupled to a power source; a switch for electrically connecting and disconnecting the plurality of light emitting diodes to the power source and activating an operating mode including sequential flashing of the plurality of light emitting diodes, the plurality of light emitting diodes and the power source being disposed in the inner cavity; and a removable base configured to be secured to the inner wall, the removable base defining a bottom portion of the housing, the switch being located in the removable base.

13 Claims, 3 Drawing Sheets

UTILITY LIGHT

CROSS REFERENCE TO RELATED APPLICATIONS

This application claims the benefit of U.S. Provisional Patent Application Ser. No. 60/837,063 filed Aug. 11, 2006 the contents of which are incorporated herein by reference thereto.

BACKGROUND

The present invention relates to a light assembly and in particular a portable light assembly configured to provide a light source or a signaling device.

Disabled vehicles on highways, local and/or inner city streets may cause traffic jams, as well as blocking a shoulder or a portion of the roadway depending upon the location of the disabled vehicle. In order to provide an indication to other motorists who may be traveling towards the disabled vehicle, it is desirable to provide some sort of indication means that would effectively notify the oncoming motorists that the vehicle is disabled. This is particularly important in nighttime or other operating conditions when visibility is limited.

One typical means for notifying oncoming motorists that a vehicle is disabled is through the use of flares. Flares produce bright light or intense heat and can be used for signaling, illumination, or defensive countermeasures. The light or intense heat is produced through the combustion of metals, for example, magnesium metals, which may include other metals for producing color to the light (e.g., red light). Most flares emit light for a limited time ranging from 5 minutes to 60 minutes, depending on the flare type. Flares also release a gaseous substance into the atmosphere causing a portion of the air to be clouded with smoke until the smoke disperses evenly through the atmosphere.

For this reason, the inventors herein have recognized that it is desirable to have a portable light assembly for use in a vehicle that provides a light source or a signaling device for effectively notifying motorist, highway patrolmen, truck drives, tow truck drives and the like. The inventors herein have also recognized that it is desirable to have a portable light assembly that is configured to provide ease in storing, use and be packaged in an efficient manner.

SUMMARY OF THE INVENTION

Thus, in accordance with exemplary embodiments of the present invention there is provided a light assembly having dual functions of a light source as well as a signaling device for effectively notifying motorist, highway patrolmen, truck drives, tow truck drives and the like.

In one exemplary embodiment, a light assembly is provided the light assembly, comprising: a translucent housing; an inner wall disposed in the translucent housing, the inner wall and the translucent housing defining an inner cavity; a plurality of light emitting diodes electrically coupled to a power source; a switch for electrically connecting and disconnecting the plurality of light emitting diodes to the power source and activating an operating mode including sequential flashing of the plurality of light emitting diodes, the plurality of light emitting diodes and the power source being disposed in the inner cavity; and a removable base configured to be secured to the inner wall, the removable base defining a bottom portion of the housing, the switch being located in the removable base.

In another exemplary embodiment, a method for removably securing a base portion to a translucent housing of a light assembly is provided, the method comprising: providing a base portion with a planar surface and a flange portion depending away from the planar surface, the flange portion having at least one tab and at least one O-ring configured to removably engage a portion of the housing and an inner wall of the housing; and securing the base portion to the housing by position the at least one O-ring between the portion of the housing and the inner wall and by engaging a feature of the at least one tab with an opening in the inner wall.

DETAILED DESCRIPTION OF EXEMPLARY EMBODIMENTS OF THE INVENTION

Figure 1:
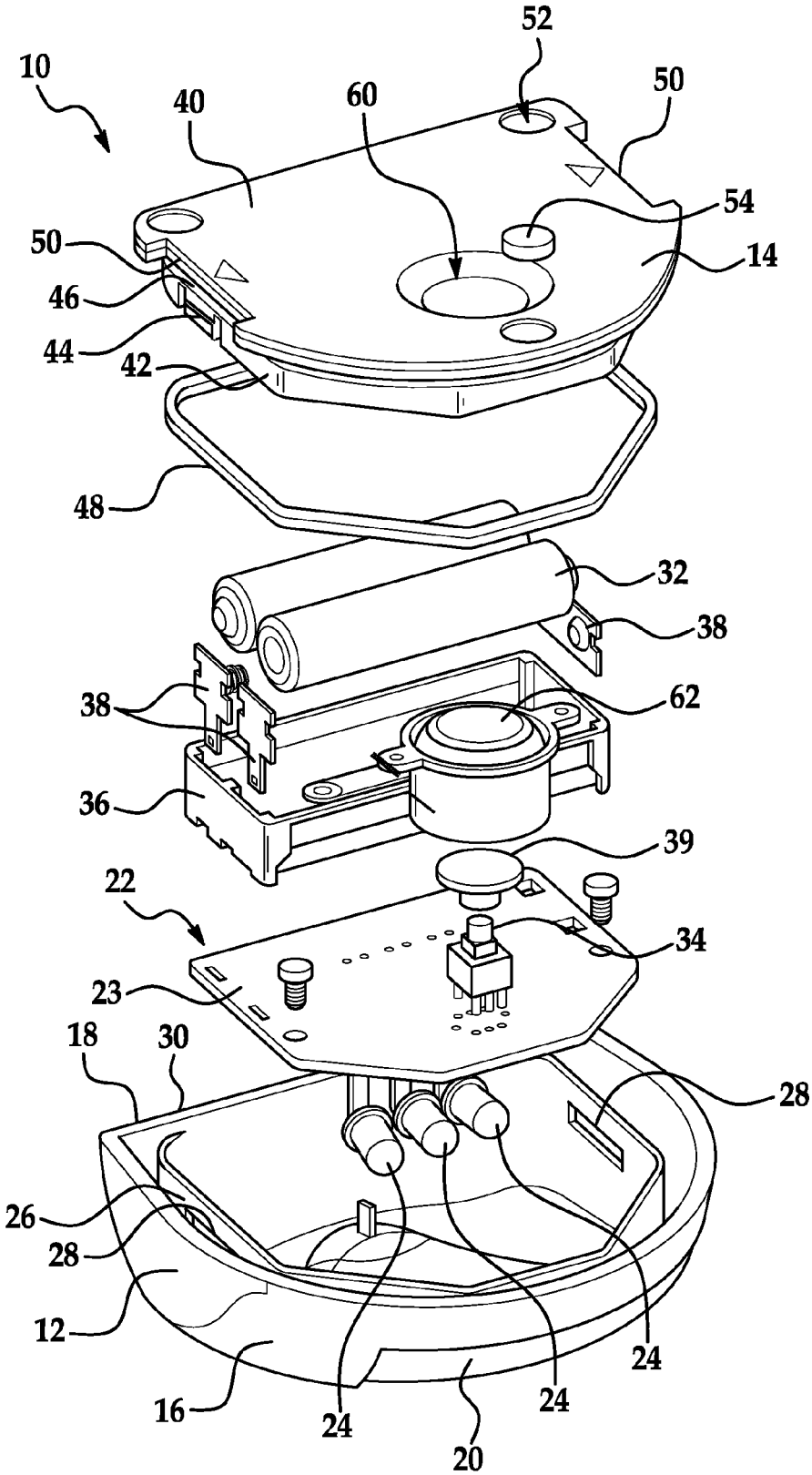
FIG. 1 illustrates an exploded perspective view of a light assembly in accordance with an exemplary embodiment of the present invention.
Figure 2:
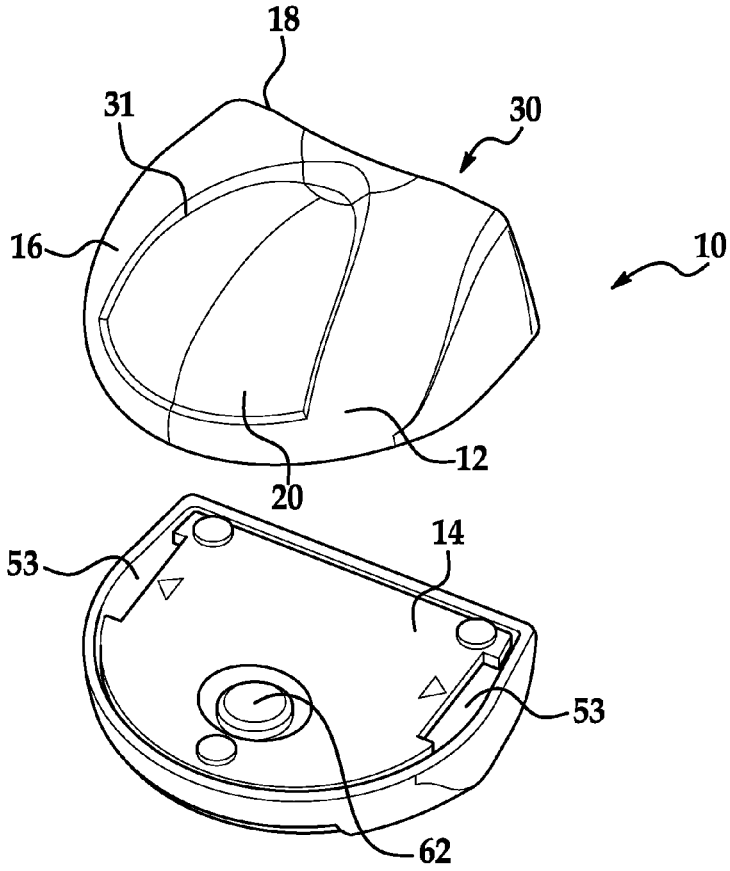
FIG. 2 illustrates a perspective view of top portion and a bottom portion of the light assembly in accordance with an exemplary embodiment of the present invention.

Exemplary embodiments of a light assembly and a method of assembling and/or operating the same in accordance with the present invention will now be described with reference to the drawings. An exemplary embodiment of a light assembly described herein is configured to provide a light source or a signaling device. In addition and in accordance with an exemplary embodiment of the present invention, the light assembly is configured to provide ease in storing and be packaged in an efficient manner.

For a better understanding of the invention and its operation, turning now to the drawings, FIGS. 1-5 illustrate a light assembly 10 in accordance with exemplary embodiments of the present invention. More specifically, FIGS. 1-5 illustrate light assembly 10 having both the functionality of a signaling or warning light in accordance with exemplary embodiments of the present invention. In one exemplary embodiment, light assembly 10 comprises a housing 12 and a removable base 14.

In one exemplary embodiment, housing 12 includes a front housing portion 16, a rear housing portion 18, and a translucent lens 20 located proximate to front housing portion 16. In one non-limiting exemplary embodiment, housing 12 generally has a parabolic shape. Of course, other shapes (e.g., triangular) are contemplated to be within the scope of exemplary embodiments of the present invention. In one non-limiting exemplary embodiment, housing 12 generally has a dome-like shape, thus providing rigidity to assembly 10 wherein the light assembly is capable of being run over by a vehicle without destroying the assembly. The housing 12 defines an interior space configured to hold therein an electrical circuit 22, which may comprise of a printed circuit board (PCB) 23 in accordance with one exemplary embodiment. In one embodiment, a number of light emitting diodes (LEDs) 24 are disposed within housing 12 and mounted on or electrically coupled to PCB 23, which is fixedly attached within the interior space of housing 12 in accordance with one exemplary embodiment.

In one embodiment, housing 12 includes an interior wall 26 integrally formed with the housing and within an interior space of housing 12. The interior wall having a plurality of slots 28 formed along a portion of the same in accordance with one non-limiting exemplary embodiment. The interior wall 26 is configured to secure to the housing to base 14, thus forming light assembly 10. In one non-limiting exemplary embodiment, there are two slots 28 formed along interior wall 26 and PCB 23 is located within and surrounded by interior wall 26.

In one non-limiting exemplary embodiment, housing 12 is manufactured through a conventional molding process (e.g., injection molded, blow molding, or the like) and constructed out of a plastic material, such as polycarbonate. Of course, other suitable plastic materials or equivalents thereof could be used to construct housing 12. In one embodiment, housing 12 is constructed out of a translucent material and translucent lens portion 20 is integrally formed with housing 12 (e.g., all portion of the housing is translucent or only some portions are translucent). The housing 12 may be configured to be of any desirable color (e.g., clear, red, white, yellow, etc.) thus, the color of the housing will provide the color of the light being emitted. In one exemplary embodiment, the housing 12 also has an internal diamond-shaped surface texture 29 configured to reflect light from oncoming traffic. In one embodiment, the diamond shaped texture or equivalents thereof is positioned around the lens portion.

Figure 5:
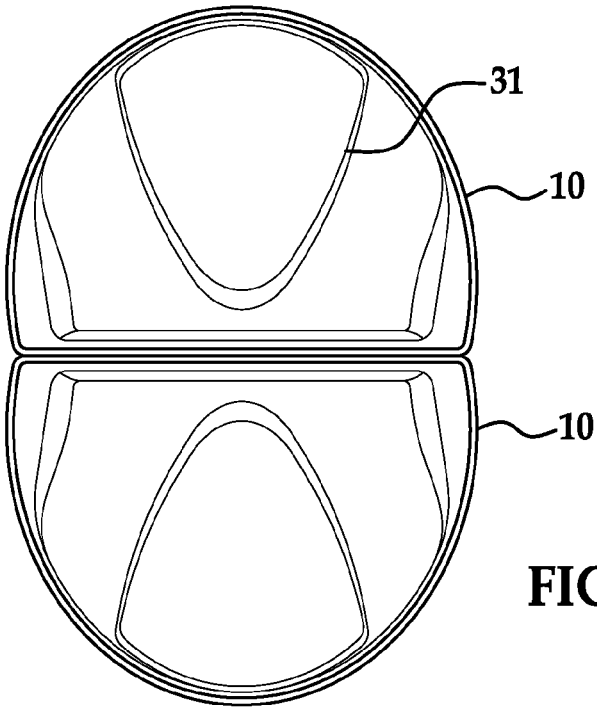
FIG. 5 illustrates a top view of two light assemblies packaged in a back-to-back manner in accordance with an exemplary embodiment of the present invention.

In one exemplary embodiment, the rear-housing portion 18 of housing 12 comprises a substantially vertical wall 30. As such, light assembly 10 can be placed in an upright position when vertical wall 30 is disposed on a surface. Furthermore, vertical wall 30 of housing 12 is configured to provide ease in packaging. For example, two light assemblies of the configurations shown in the drawings can be packaged together such that the vertical wall of each assembly can be placed adjacent to each other in a back-to-back manner as illustrated in FIG. 5. Those skilled in the art will appreciate that such a design minimizes wasted space in packaging as well as allow a number of assemblies to be stored and packaged together in a cost-effective manner.

Figure 3:
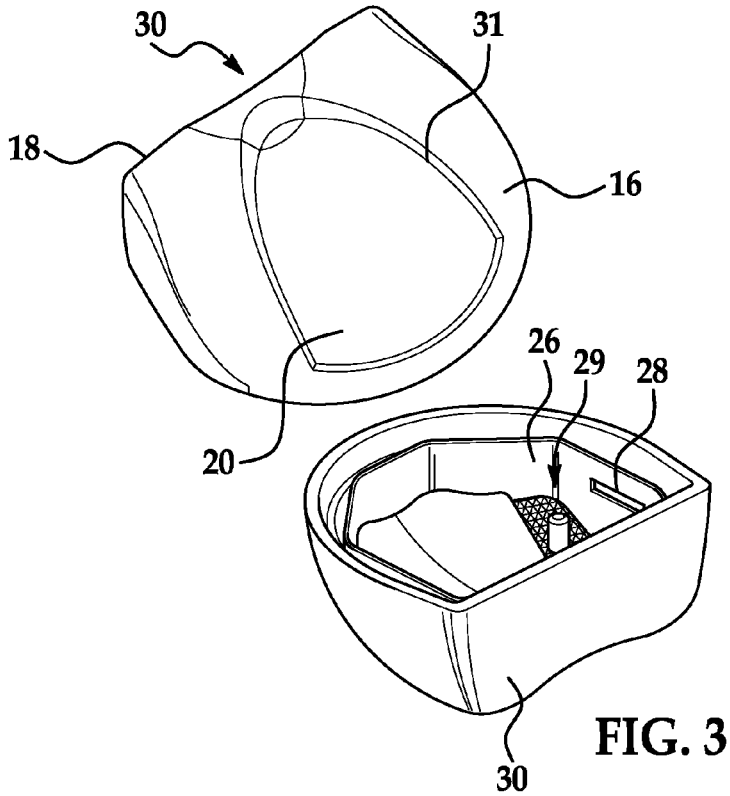
FIG. 3 illustrates various perspective views of a housing of an exemplary embodiment of the present invention.

In one exemplary embodiment, housing 12 includes a plurality of rib details for orienting some or all of the LEDs 24 at an angle with respect to a vertical axis extending through assembly 10. In one non-limiting exemplary embodiment, the angle of some or all of the LEDs 24 are oriented approximately 12 degrees from the vertical axis extending through assembly 10 as shown in FIG. 3. In one non-limiting exemplary embodiment, the angle of some or all of the LEDs 24 are oriented approximately 12 degrees from the vertical axis extending through translucent lens 20. Of course, other angles are contemplated for use in exemplary embodiments of the present invention.

In accordance with an exemplary embodiment, the LEDs 24 are disposed behind translucent lens 20, which may be configured to have any desired color (e.g., clear, red, white, yellow, etc.). As such, when light assembly 10 is operated, the LEDs 24 emit light that propagates through translucent lens 20 in the color selected for translucent lens 20. It should be noted that in an alternative exemplary embodiment one or more of LEDs 24 could be replaced with halogen bulbs or other equivalent light emitting sources.

In one non-limiting exemplary embodiment, LEDs 24 each having a brightness of 6000 millicandelas (mcd). Of course, other brightness levels are considered to be within the scope of exemplary embodiments of the present invention. In one non-limiting embodiment, three LEDs 24 are employed in assembly 10. In one embodiment the LEDs 24 illuminate a bright red color through translucent lens 20. Of course other colors are contemplated to be within the scope of exemplary embodiments of the present invention.

In accordance with an exemplary embodiment, electrical circuit 22 includes a power or a voltage source 32 (e.g., batteries), a switch 34 (e.g., push switch) and in one embodiment a timer circuit (not shown) as well as LEDs 24. In this example, three LEDs 24 are shown in FIG. 1; however, it is contemplated that more or less than three LEDs can be utilized with exemplary embodiments of light assembly 10 and should not be limited to this example. In one exemplary embodiment, voltage source 32 is configured to energize LEDs 24 and comprises a conventional battery or batteries.

In one exemplary embodiment, light assembly 10 includes a battery holder 36, which is fixedly attached within the interior space of housing 12 and mounted on PCB 23 in accordance with one exemplary embodiment, for receiving voltage source 32. The battery holder 36 includes terminals 38 and conductive wires and contacts, as required, for electrically coupling LEDs 24 to voltage source 32. In one embodiment, battery holder 36 is constructed out of a plastic material, such as Acrylonitrile Butadiene Styrene (ABS). Of course, other suitable plastic materials or equivalents thereof could be used to construct battery holder 36.

Switch 34 can be any conventional push switch (e.g., micro-switch or equivalents thereof) having a latching action, where the switch 34 is configured to be pushed once to activate one action and pushed again to activate another action and so forth. It should be appreciated that more than one switch and other switch types and arrangements can be used to control LEDs 24 in accordance with exemplary embodiments of the present invention.

The timer circuit disclosed herein can be any conventional timer circuit known in the art for periodically energizing LEDs 24 so that LEDs 24 flash at periodic intervals in accordance with one exemplary embodiment. For a more detailed explanation of a suitable timer circuit, see U.S. Pat. No. 5,627,513, titled "Portable Visual Emergency Signal Device" filed on Apr. 25, 1995, the contents of which are incorporated herein by reference thereto. Of course, various configurations of the timer circuit can be employed in exemplary embodiments of assembly 10.

In one exemplary embodiment, switch 34 is electrically coupled in series between voltage source 32 and LEDs 24. LEDs 24 are electrically coupled in series between the timer circuit and a ground of electrical circuit 22 in accordance with one exemplary embodiment. In one exemplary embodiment, the timer circuit is electrically coupled in series with switch 34, which is a conventional timer circuit that periodically energizes the LEDs 24 so that they flash at periodic intervals.

In one exemplary embodiment, LEDs 24, switch 34 (e.g., push switch), voltage source 32, the timer circuit, or a combination thereof are mounted and arranged on PCB 23. Alternatively, it is contemplated that more than one PCB is employed to electrically couple the electrical components above, where the PCBs are then electrically coupled together within housing 12.

Optionally, light assembly 10 includes a cap 39 configured to cover switch 34. The cap 39 is configured to provide a larger surface area for engaging switch 34. In one embodiment, cap 39 is constructed out of a plastic material, such as ABS. Of course, other suitable plastic materials or equivalents thereof could be used to construct cap 39.

In accordance with an exemplary embodiment of the present invention, base 14 is configured to be removably secured to the bottom portion of housing 12. In one non-limiting exemplary embodiment, base 14 comprises a rubber-like material with sufficient flexibility for ease of removal and replacement function as well as sufficient flexibility for easy switch activations. In another non-limiting embodiment, base 14 is constructed out of a plastic-type material, such as ABS and is manufactured through a conventional molding process (e.g., injection-molding). Of course, other materials and other manufacturing processes can be used to form base 14 and should not be limited to the examples described above.

Figure 4:
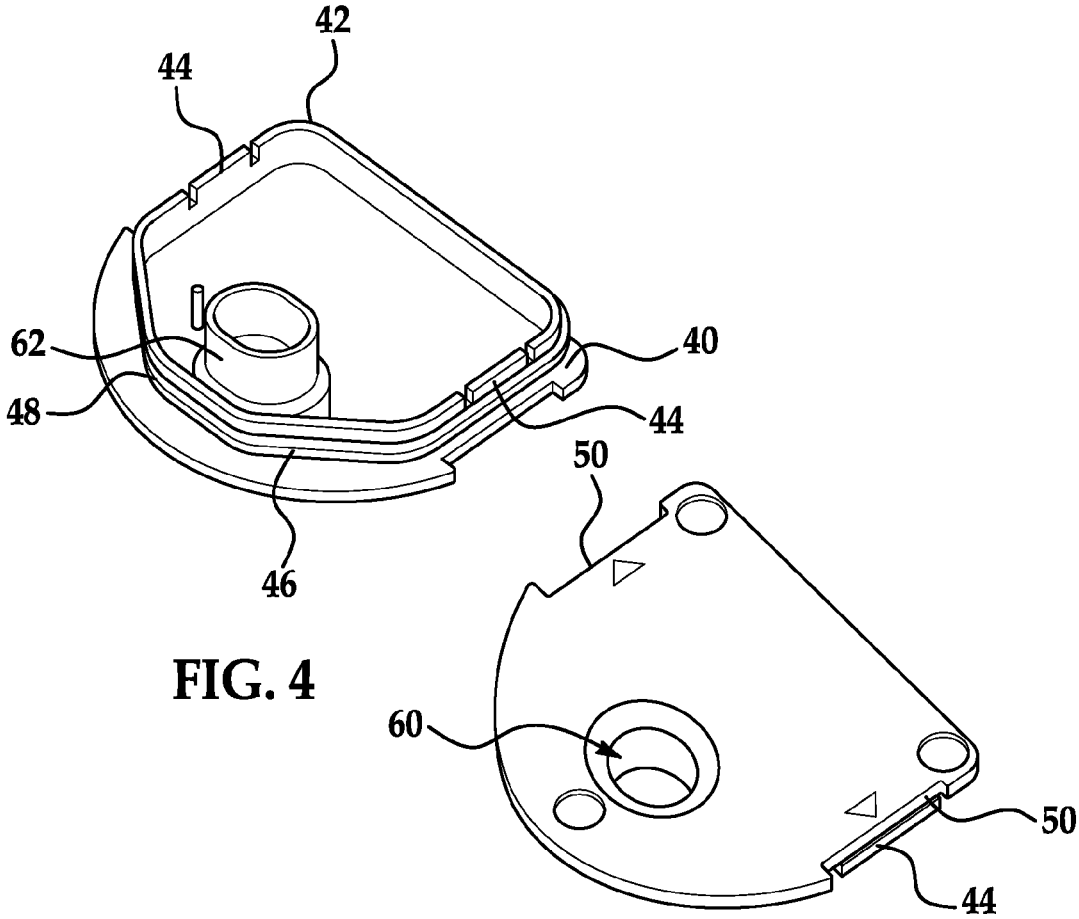
FIG. 4 illustrates various perspective views of a base of an exemplary embodiment of the present invention.

In one exemplary embodiment, removable base 14 comprises a planar surface 40 and a flange portion 42 extending therefrom that functions as a weather resistance seal interface with housing 12 as illustrated in FIG. 4 when flange 42 is secured to wall 26. Base 14 further comprises locking tabs 44 formed in flange 42. In one non-limiting exemplary embodiment, there are two locking tabs 44 formed in flange 42 of base 14. In accordance with an exemplary embodiment the locking tabs are integrally formed with the wall portion 26 and comprise a resilient material (e.g., plastic or other equivalent material) that allows the tabs to deflect and return to an original position to provide a locking or interference fit with the wall. The tabs 44 are configured to have a feature to correspondingly engage with an opening or slots 28 formed along interior wall 26 of housing 12, thus tabs removably secure base 14 to housing 12 via the interlock of the tabs of flange 42 and wall 26. Formed also along flange 42 are a plurality of grooves 46 each configured to correspondingly receive an O-ring 48. The O-rings are configured to provide a seal between interior wall 26 of housing 12 and flange 42 of base 14 when base 14 is secured to housing 12 as described above. In accordance with an exemplary embodiment of the present invention the O-ring or O-rings are disposed completely around a periphery of the flange 42 between the locking tabs and the planar surface of the base portion. As such, electrical circuit 22 is sealed within a cavity or inner cavity defined by housing 12 and base 14 via wall 26 and flange 42 and a portion of the housing. The interior cavity is protected from contaminants, such as debris or the like via the O-rings 48. Accordingly, O-rings 48 will provide a water resistant barrier. The O-rings may also provide an interference fit between housing 12 and base 14 in order to also removably secure the base to the housing. In one exemplary embodiment, two grooves 46 each having an O-ring received therein are configured to be disposed completely around a periphery portion of flange 42, wherein on groove and O-ring is spaced from the other groove and O-ring. Thus, a dual seal is provided. Of course, one or more than two grooves 46 each having an O-ring received therein can be configured to be disposed completely around a periphery portion of flange 42 in accordance with exemplary embodiments of the present invention.

In one exemplary embodiment, base 14 comprises finger areas or recess portions 50 configured to provide a means to easily grip base 14. In one non-limiting exemplary embodiment, fingers areas 50 are formed along a peripheral portion of planar surface 40 of base 14 to form a pocket or area or opening 53 between a peripheral portion of base 14 and an inner peripheral portion of housing 12. Thus, areas or openings 53 allow a user to easily remove base 14 in order to access the battery compartment or battery holder 36. Advantageously and through the use of O-rings 48 and tabs 44, base 14 can easily be secured and removed from housing 12 through the use of an individual's fingers or by simply placing an object in area 53 to pry the base away from the housing. Accordingly, the O-ring(s) and tabs allow for ease of removal and securement of the base to the housing by merely pushing the base into the housing for securement and by gripping finger areas or recessed portions 50 or placing an object or tool (e.g., screwdriver or the like) in area 53 to simply pry or pop the removable base from the housing.

Optionally and in an alternative exemplary embodiment, base 14 includes a number of molded-in foot details 52 configured for correspondingly receiving a number of stoppers 54, which in accordance with one exemplary embodiment are constructed out of a rubber-like material. In one non-limiting exemplary embodiment, stoppers 54 are adhered within foot details 52. In one non-limiting exemplary embodiment, base 14 includes three stoppers distanced apart from one another. The stoppers 54 are utilized for providing friction between light assembly 10 and a surface (e.g., the road surface). As such, light assembly 10 can easily be positioned on dry and wet surfaces.

The base 14 further comprises an opening 60 for receiving a push button 62 constructed out of an elastic material, such as silicon. In one exemplary embodiment, an interference fit is provided between opening 60 and push button 62. In another exemplary embodiment, push button 62 is molded together with base 14. In another exemplary embodiment, push button 62 is heat staked to base 14. Alternatively, push button 62 can be secured to a portion of base 14 through the use of a fastener (e.g., a screw). In one embodiment, push button 62 is used to activate LEDs 24. In this case, push button 62 is configured to engage with switch 34 or with cap 39 when a user depresses push button 62 to activate LEDs 24. Alternatively, switch 34 is depressed directly by the user to activate LEDs 24 and is received through opening 60 of base 14 in accordance with one exemplary embodiment.

In one non-limiting exemplary embodiment, electrical circuit 22 is configured to provide an on/off feature as well as a switching feature for a strobe function. Of course other functions, such as a steady light function with high and low light capabilities (e.g., only lighting some or all of the LEDs) can be provided in one exemplary embodiment of the present invention.

Some non-limiting functions include depress push button 62 once and all LEDs 24 are steady on (e.g., all LEDs on continuously), depress push button 62 a second time and a rotating loop will active, for example, a plurality of one-second loops, and depress push button 62 a third time and all LEDs 24 are turned off. An example of a looping function if three LEDs 24 are used would be as follows: LED 1 on, LED 1 off; LED 2 on, LED 2 off; LED 3 on, LED 3 off; LED 1 off, LED 1 off, etc. In accordance with another non-limiting exemplary embodiment, push button 62 or switch 34 mounted on PCB 23 is configured to function as follows: push once for steady LED light function, push a second time for flashing LED function (e.g., all LEDs flashing at once), push a third time to turn off. In one non-limiting exemplary embodiment, push button 62 or switch 34 is configured to function as follows: push once for flashing LED function, push a second time to turn off. It is contemplated that other light patterns or arrangements (e.g., slow to fast flashing) can be employed with exemplary embodiments of light assembly 10.

Alternatively, light assembly 10 may be configured to have a single function which may be any of the functions described above wherein switch 34 is used to merely provide a means for turning the light assembly on and off.

In accordance with an exemplary embodiment of the present invention, an exemplary method for operating light assembly 10 is provided. In this exemplary method, base 14 is removed from housing 12. The operator may use the easy grip finger areas 50 to remove base 14 away from housing 12. Next, voltage source 32 (e.g., batteries) is inserted into battery holder 36, which is fixedly attached within the interior space of housing 12. As such, voltage source 32 is electrically coupled to switch 34 and consequently to LEDs 24. Then, base 14 is secured to housing 12. In one exemplary embodiment, base 14 is secured to housing 12 wherein features of tabs 44 correspondingly engage with slots or opening 28. Then, push button 62 is depressed to activate the light assembly (e.g., flashing light function). Optionally, switch 34 can be engaged directly. The light assembly can then be placed on any surface (e.g., road) wherein it is now visible.

Exemplary embodiments of light assembly 10 provide substantial advantages over known light assemblies. In particular, the exemplary embodiments of light assembly provide an electronic alternative for incendiary flares. Furthermore, exemplary embodiments of the present invention provide a light source or signaling device for motorists, highway patrolmen, truck drivers, tow truck drivers, and the like. Furthermore, exemplary embodiments of the present invention provide a design that allows a number of assemblies to be stored and packaged together in a cost-effective manner.

Some other features of light assembly 10 include high visibility, red warning lights, self-standing, rubber base, rugged, weather proof, and battery powered.

Some non-limiting examples of suitable materials for components of the utility light include acrylics or other plastic materials.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed for carrying out this invention, but that the invention will include all embodiments falling within the scope of the appended claims. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced items.

What is claimed is:

1. A light assembly, comprising:

a translucent housing;

an inner wall disposed in the translucent housing, the inner wall and the translucent housing defining an inner cavity;

a plurality of light emitting diodes electrically coupled to a power source;

a switch for electrically connecting and disconnecting the plurality of light emitting diodes to the power source and activating an operating mode including sequential flashing of the plurality of light emitting diodes, the plurality of light emitting diodes and the power source being disposed in the inner cavity; and a removable base configured to be secured to the inner wall, the removable base defining a bottom portion of the housing and a button for actuating the switch is located in the removable base, wherein the removable base has a plurality of tabs for removably securing the removable base to the inner wall and the inner wall includes a plurality of slots for correspondingly receiving a portion of the plurality of tabs, the removable base being secured to the housing when the plurality of tabs are received by the plurality of slots.

2. The light assembly as in claim 1, wherein the removable base is constructed out of a plastic material.

3. A light assembly, comprising:

a translucent housing;

an inner wall disposed in the translucent housing, the inner wall and the translucent housing defining an inner cavity;

a plurality of light emitting diodes electrically coupled to a power source;

a switch for electrically connecting and disconnecting the plurality of light emitting diodes to the power source and activating an operating mode including sequential flashing of the plurality of light emitting diodes, the plurality of light emitting diodes and the power source being disposed in the inner cavity; and a removable base configured to be secured to the inner wall, the removable base defining a bottom portion of the housing, and a button for actuating the switch is located in the removable base, wherein the removable base comprises a planar surface having a flange portion extending outwardly therefrom, the flange portion having a pair of tabs configured to engage a pair of openings in the inner wall.

4. The light assembly as in claim 3, wherein the flange portion has at least one groove configured to receive an O-ring for providing a seal between the flange portion and the housing and the inner wall.

5. The light assembly as in claim 3, wherein the flange portion has a pair of grooves disposed between the pair of tabs and the planar surface and each groove has an O-ring for providing a seal between the flange portion and a rear portion of the housing and the inner wall.

6. The light assembly as in claim 5, wherein the removable base has a pair of areas disposed on the periphery of the removable base, the pair of areas each defining a pocket between the periphery of the removable base and the housing, the pockets allowing a force to be applied to the removable base to remove the removable base from the housing.

7. A light assembly, comprising:

a translucent housing;

an inner wall disposed in the translucent housing, the inner wall and the translucent housing defining an inner cavity;

a plurality of light emitting diodes electrically coupled to a power source;

a switch for electrically connecting and disconnecting the plurality of light emitting diodes to the power source and activating an operating mode including sequential flashing of the plurality of light emitting diodes, the plurality of light emitting diodes and the power source being disposed in the inner cavity; and a removable base configured to be secured to the inner wall, the removable base defining a bottom portion of the housing, and a button for actuating the switch is located in the removable base, wherein the removable base has a pair of areas disposed on the periphery of the removable base, the pair of areas each defining a pocket between the periphery of the removable base and the housing, the pocket allowing a force to be applied to the removable base to remove the removable base from the housing.

8. The light assembly as in claim 7, wherein the housing has a substantially flat vertical wall along one side.

9. The light assembly as in claim 7, wherein at least one of the plurality of light emitting diodes is oriented approximately 12 degrees from a vertical axis extending through the housing.

10. The light assembly as in claim 7, wherein the housing has a substantially parabolic shape.

11. The light assembly as in claim 7, wherein the power source is a battery.

12. The light assembly as in claim 7, further comprising a printed circuit board configured to have fixedly mounted therein the plurality of light emitting diodes, the switch, the power source, or a combination thereof, the printed circuit board being received within the inner cavity.

13. The light assembly as in claim 12, wherein the printed circuit board is fixedly attached to a portion of the housing.

* * * * *